United States Patent [19]

Biermann et al.

[11] Patent Number: 4,646,668

[45] Date of Patent: Mar. 3, 1987

[54] UNIVERSAL SEWING FOOT

[75] Inventors: Kurt Biermann; Gerhard Steppat, both of Bielefeld, Fed. Rep. of Germany

[73] Assignee: Durkoppwerke GmbH, Fed. Rep. of Germany

[21] Appl. No.: 839,800

[22] Filed: Mar. 14, 1986

[30] Foreign Application Priority Data

Mar. 22, 1985 [DE] Fed. Rep. of Germany ..... 3510380

[51] Int. Cl.[4] ..... D05B 27/04

[52] U.S. Cl. ..... 112/320; 112/311

[58] Field of Search ..... 112/320, 237, 311, 321

[56] References Cited

U.S. PATENT DOCUMENTS 3,583,343 6/1971 Meier et al. ..... 112/320
4,056,071 11/1977 Adams ..... 112/237
4,487,145 12/1984 Vollmar ..... 112/320
4,519,333 5/1985 Minakuchi ..... 112/320 X

FOREIGN PATENT DOCUMENTS 6924107 6/1969 Fed. Rep. of Germany .

*Primary Examiner*—Werner H. Schroeder
*Assistant Examiner*—Andrew M. Falik
*Attorney, Agent, or Firm*—Ostrolenk, Faber, Gerb & Soffen

[57] ABSTRACT

A universal sewing foot, for a sewing machine having a skipping top transport and a skipping bottom transport, comprises an advancing foot and a holding foot which alternately engage the workpiece. A locking member selectively locks the holding foot so that it operates either in a non-skipping mode, in which the foot is urged downward against the workpiece by a spring, or a skipping mode, in which the foot is locked to the skipping upper transport with the spring under compression.

23 Claims, 5 Drawing Figures

UNIVERSAL SEWING FOOT

BACKGROUND OF THE INVENTION

1. Field of the Invention

The present invention relates to a universal sewing foot for a sewing machine with a skipping top transport and a skipping bottom transport. It relates more particularly to a universal sewing foot comprising an advancing foot and a holding foot, the holding foot being selectively lockable to the top transport so as to function in either a skipping or a non-skipping mode.

2. Description of Related Art

A sewing machine upper transport device having an advancing foot and a holding foot for alternately engaging the workpiece is known. Federal Republic of Germany Pat. No. 26 20 209 discloses such a transport device, which is driven by a flat crank mechanism. The crank mechanism is so designed that it reduces the speed of the advancing and holding feet to zero at the lower limit of their downward movement. In this device, the holding foot, like the advancing foot, operates only in a skipping mode. Thus, the known sewing machine upper transport device does not permit its holding foot to operate selectively as a non-skipping presser foot.

SUMMARY OF THE INVENTION

Accordingly, a principal object of the invention is to provide a holding foot which can be simply controlled to operate selectively either as a skipping foot or as a non-skipping presser foot.

With the universal sewing foot of the invention, it is possible for a single sewing foot to operate in the following modes of operation:

1. If a given foot sole of the holding foot is locked in its elevated position, that part of the holding foot operates as a skipping presser foot.

2. If a given foot sole of the holding foot is not locked in its upper position, then that part of the holding foot operates as a non-skipping presser foot, since the upward and downward movement of the foot bar of the upper transport mechanism is compensated for by a pressure spring which presses such foot sole downward to the workpiece.

3. If, in a holding foot having two foot soles, one foot sole is locked in its elevated position while the other is not, then the universal sewing foot is suitable for edge sewing work, since in this case the non-skipping foot sole, that is, the one not locked in its elevated position, serves as a stop for the sewing material.

According to an embodiment of the invention, a holding foot comprises a block secured to the top transport, and at least one foot sole which is mounted on the block and vertically movable with respect thereto. Spring means are mounted between the block and the foot sole for urging the foot sole downward into non-skipping engagement with the workpiece during vertical reciprocation of the top transport. Locking means are also provided for locking the foot sole to the block so that the foot sole reciprocates vertically with the top transport, in skipping engagement with the workpiece.

Advantageously, the holding foot comprises a pair of foot soles independently mounted on the block in the preceding manner.

BRIEF DESCRIPTION OF THE DRAWINGS

Other objects, features and advantages of the invention will be seen in the following detailed description of preferred embodiments, with reference to the drawings, in which.

DETAILED DESCRIPTION OF PREFERRED EMBODIMENTS

Figure 1:
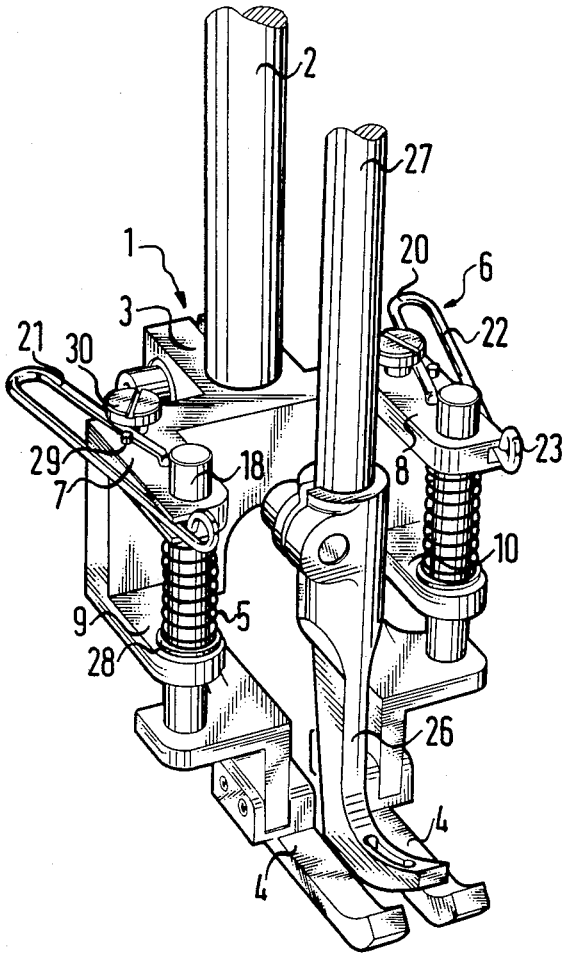
FIG. 1 is a perspective view of a first embodiment of a universal sewing foot for use with the upper transport of a sewing machine, the sewing foot comprising an advancing foot, and a holding foot which has two foot soles.

In FIG. 1 there is seen a first preferred embodiment of a universal sewing foot, which comprises an advancing foot 26 and a holding foot 1. The feet 1 and 26 are for use with the upper transport of a sewing machine, which has two foot bars 2 and 27 for actuating the feet 1 and 26, respectively.

The advancing foot bar 27 carries out an upward and downward movement and, in addition, a front-and-back movement in the direction of transport of the material being sewn, and supports and actuates the advancing foot 26 in this manner. In contradistinction to this, the foot bar 2 carries out only an upward and downward movement and serves to support and actuate the holding foot 1, which preferably has two foot soles 4. The two foot soles will be referred to hereinafter as "right" and "left," as seen in FIG. 1.

For retaining the holding foot 1 on the foot bar 2, a receiving hole 11 is located in a clamping region of the block 3 which forms the body of the holding foot 1. (See FIG. 2.) The block has two upper arms 7, 8 and two lower arms 9, 10. The ends of the arms 7, 8, 9 and 10 include aligned holes 12, whose center lines are parallel to the receiving hole 11. The forward corner of each arm 7, 8 has an outer groove 13 which extends obliquely with respect to the corresponding outer side of the arm 7, 8. Depending on the number of foot soles 4 on the holding foot 1, a corresponding number of slots 14 are formed in the front of the block 3. The slots 14 are parallel to the center lines of the holes 12.

Each foot sole 4 is firmly attached to a vertical side of an angle bracket 15 so as to be secured against rotational movement. On the top side of a horizontal leg 16 of the angle bracket 15, an upward-directed spur 17 is provided. An upward-directed bolt 18 is firmly attached to the leg 16, for instance by riveting or soldering. It is desirable for dependable upward and downward movement of the foot sole 4 that the spur 17 and the bolt 18 be arranged perpendicular to the top side of the leg 16.

Figure 3:
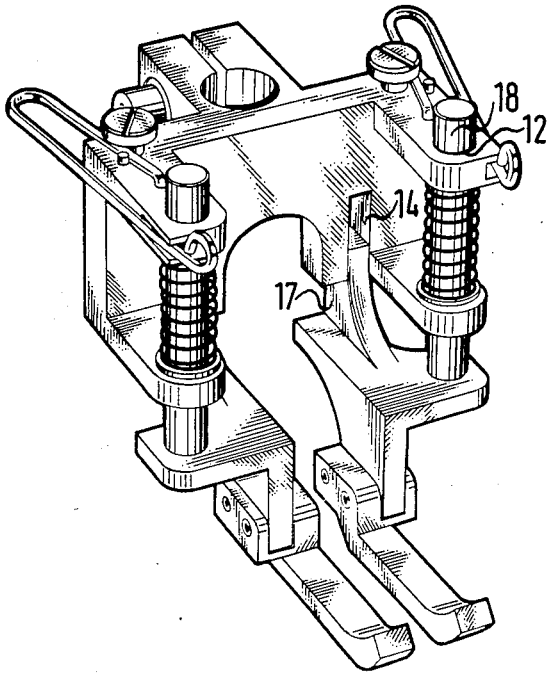
FIG. 3 is a perspective view of the holding foot of FIG. 1, both of the foot soles being unlocked and pressed downward by pressure springs.

The bolt 18 has a circumferential groove cut in it to receive a conventional retaining ring 28. The latter limits the downward-directed movement of the foot sole 4 (see FIG. 3) and serves furthermore as a lower abutment for a pressure spring 5 which is arranged between the bottom of the arm 7 or 8 and the top of the corresponding retaining ring 28.

Each foot sole 4 is locked to the block 3 by inserting the corresponding bolt 18 into the holes 12 and in the left arms 7, 9, and the right arms 8, 10. In the same operation, the bolt is inserted through the pressure spring 5, and the spur 17 engages a corresponding slot 14 in the block 3. The elevated position of the foot sole 4, to be discussed further below, is obtained after pressure of the compression spring 5 when the top of the leg 16 contacts the bottom of the arm 9 or 10. In this position the individual turns of the pressure spring 5 should not be in contact. The bolt 18 furthermore has a slot 19 which extends parallel to the groove 13, the bottom of which is flush with the top of the arm 7 or 8 when the foot sole is in its elevated position.

On the top of the block 3 there are provided locking members comprising two spring wire yokes 20 whose rear legs 21 are firmly attached to the block 3. This can be achieved, for instance, by fastening the bent end of the rear leg 21 between a small pin 29 embedded in the block 3, and the head of a fillister-head screw 30 on the block 3. A downwardly-bent portion at the rear end of the rear leg 21 extends into a hole provided in the top surface of the block 3 (see FIG. 1). A front spring leg 22 of the yoke 20 has a round eyelet 23 at its end.

Figure 5:
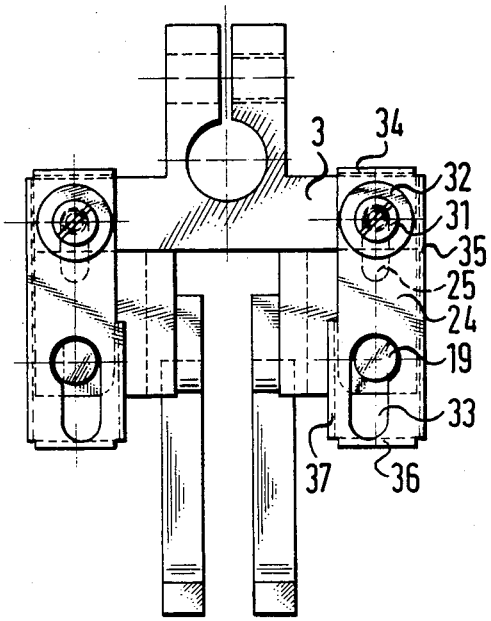
FIG. 5 is a top view of a second embodiment of a holding foot, in which the foot soles can be locked in an elevated position by displaceable slide locks.

Referring to FIG. 5, in an alternate preferred embodiment of the invention, each locking member instead comprises a slide lock 24 which is displaceable forward and backward, and is attached to the block 3. Each slide lock is preferably formed as a sheet-metal part having four arms 34, 35, 36 and 37, which are bent downward to surround in a form-locked manner one of the upper arms 7 or 8 of the block 3. Each slide lock 24 has therein pairs of left and right slots 25 and 33 whose longitudinal edges extend parallel to the corresponding outer edges of the arms 7 and 9, the latter having no grooves 13 in this embodiment. The slide lock 24 is friction-mounted to the block 3 by a pair of shoulder screws 31 and spring washers 32 inserted into the slots 25. Each slot 33 is formed with a narrow forward portion and a wider rear portion. When the slide lock 24 is in a forward position on the block 3, the rear portion of the slot 33 completely surrounds a corresponding bolt 18 and does not interfere with its vertical movement. When the slide lock 24 is in a rearward position, the narrower portion of the slot 33 engages the slot 19 of the corresponding bolt so as to lock the bolt 18 to the block 3.

The manner of operation of the universal sewing foot of FIGS. 1–4 will now be described: When the legs 22 of each spring wire yoke 20 are in their inactive position, that is, when they are inserted into the grooves 13 (see FIG. 3), then the foot soles 4 are pressed continuously downward by the spring force of the pressure springs. The upward and downward movement of the foot bar 2 is thus completely compensated for. The holding foot 1 remains continuously pressed against the workpiece, thus operating as a non-skipping presser foot.

Figure 4:
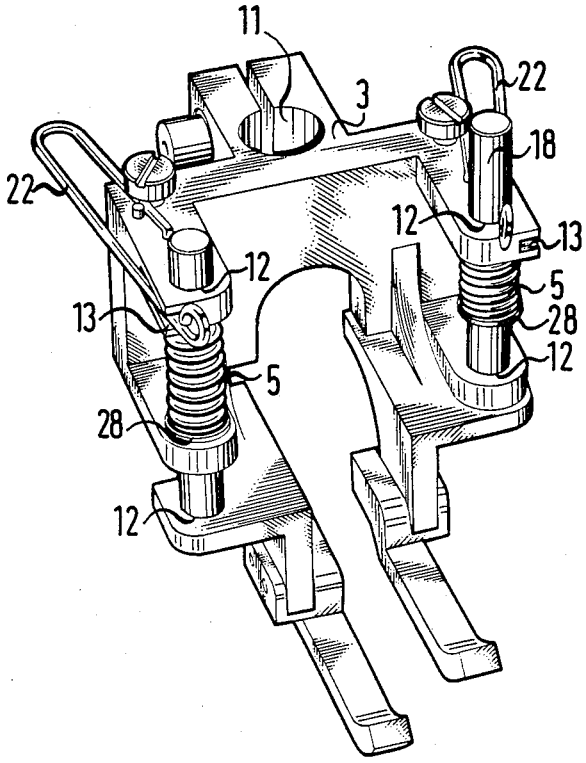
FIG. 4 is a perspective view of the holding foot of FIG. 1, the right foot sole being locked in elevated position, and the left foot sole being unlocked.

If, however, the front leg 22 of the right-hand spring wire yoke 20 is lifted out of the groove 13 and shifted slightly upward so that it rests against the bolt 18, then the front leg 22, upon downward movement of the block 3, enters into the slot 19 when the block 3 has reached its lowest portion (see FIG. 4). In this situation, the right-hand foot sole 4 is locked in its elevated position and therefore operates as a skipping presser foot. The unlocked left-hand foot sole 4, on the other hand, still operates as a non-skipping presser foot since the pressure spring 5 continuously presses this foot sole 4 downward independently of the upward and downward movement of the block 3.

In the latter situation, the left-hand edge of a piece of sewing material can be placed against the right-hand edge of the left foot sole 4, which is now continuously pressed downward, so that a seam can be sewn parallel to the left-hand edge. However, if a seam is to be sewn parallel to the right-hand edge of a piece of sewing material, then the leg 22 of the right-hand spring wire yoke 20 is placed into the corresponding groove 13 while the leg 22 of the left-hand spring wire yoke 20 is lifted out of the corresponding groove 13 and placed against the bolt 18.

Figure 2:
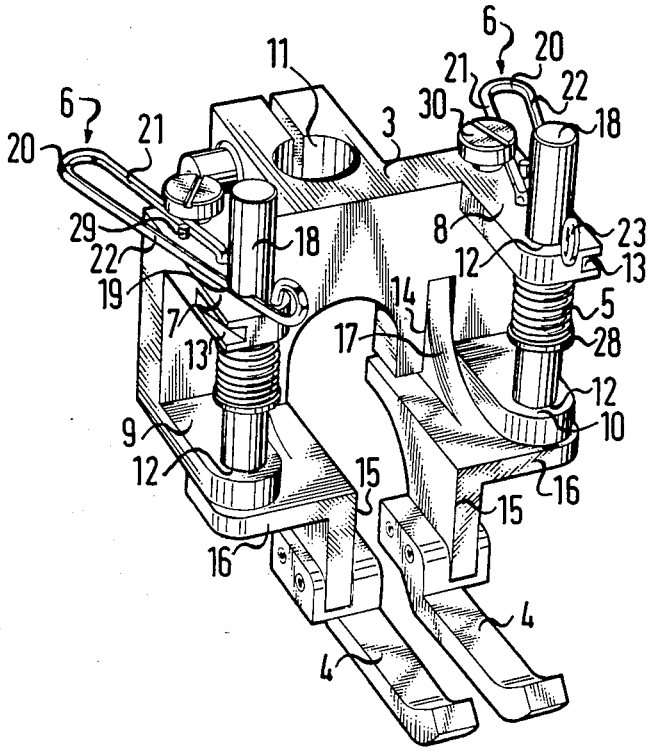
FIG. 2 is a perspective view of the holding foot of FIG. 1, both of the foot soles being locked in their elevated position.

If the legs 22 of both spring wire yokes 20 are lifted out of the grooves 13 and placed against the bolts 18, then both the legs 22 enter the slots 19 provided for them when the block 3 has reached its lowest position (see FIG. 2). In this case, both foot soles 4 are locked in their elevated positions, i.e., the holding foot 1 now operates as a skipping presser foot.

In the embodiment shown in FIG. 5, in the position of both slide locks 24 shown in FIG. 5, the foot soles 4 are not locked in their elevated position. If at the moment that the lower edges of the slot 19 are flush with the top of the arms 7, 8 both slides 24 are pushed rearward, then the foot soles 4 become locked in their elevated position. In this case, the corresponding longitudinal edge of each slot 33 is received by a corresponding slot 19.

Thus, in these embodiments, the holding foot can be locked into an elevated position in which it moves up and down with the top transport in a skipping mode; or unlocked so that it is urged downward by a spring in a non-skipping mode for continuous contact with the workpiece despite the movements of the transport.

Although illustrative embodiments of the invention have been described herein, it is to be understood that the invention is not limited to such embodiments. Rather, variations and modifications may occur to those skilled in the art within the scope of the invention, as defined by the following claims.

What is claimed is:

1. A holding foot for a sewing machine having a skipping top transport which reciprocates vertically with respect to a workpiece, comprising a block for being secured to the top transport for vertical reciprocation therewith;

at least one foot sole which is mounted on the block and vertically movable with respect thereto;

spring means mounted between the block and the foot sole for urging the foot sole downward into non-skipping engagement with the workpiece during vertical reciprocation of the block; and locking means on one of the foot sole and the block, for selectively locking the foot sole to the block so that the foot sole reciprocates vertically therewith, the foot sole then being in skipping engagement with the workpiece.

2. A holding foot as in claim 1, in which the foot sole is secured against rotation with respect to the block.

3. A holding foot as in claim 1, in which the top transport has a foot bar for actuating the holding foot, the block being secured to the foot bar.

4. A holding foot as in claim 1, further comprising a vertical shaft for mounting the foot sole on the block, the shaft being secured to the foot sole, and the shaft being accommodated movably in an aperture defined in the block.

5. A holding foot as in claim 4, in which an abutment is formed on the shaft, and the spring means comprises a pressure spring which is disposed for being compressed between said abutment and a portion of the block adjacent the aperture in which the shaft is accommodated.

6. A holding foot as in claim 4, in which the locking means comprises a locking member mounted on the block for being selectively moved into locking engagement with the shaft.

7. A holding foot as in claim 6, in which the shaft has a slot defined therein for receiving the locking member in such locking engagement.

8. A holding foot as in claim 7, in which the locking member is a spring wire.

9. A holding foot as in claim 8, in which the spring wire is mounted on the block for being inserted in the slot by a swinging movement.

10. A holding foot as in claim 8, in which the spring wire is bent into a U-shape, having a rear leg which is attached to the block, and a front leg which is insertable into the slot by a swinging movement.

11. A holding foot as in claim 10, in which the front leg is bent into a curved shape for being handled to perform said swinging movement.

12. A holding foot as in claim 7, in which the locking member is a slide lock slidingly mounted on the block for movement in two directions, the slide lock being received in the slot on the shaft when moved in one of such directions.

13. A holding foot as in claim 12, in which the slide lock is friction-mounted for opposing motion of the slide lock with respect to the block.

14. A holding foot as in claim 13, in which the slide lock is secured to the block by a shoulder screw and a spring washer.

15. A holding foot as in claim 1, comprising a pair of foot soles and a corresponding pair of vertical shafts for mounting said foot soles, each shaft being secured to the respective foot sole, being accommodated in a respective aperture defined in the block, and having an abutment formed thereon;

the spring means comprising a pair of pressure springs, each spring being disposed for being compressed between a respective abutment formed on one of said shafts, and a portion of the block adjacent the respective aperture in which the shaft is accommodated, the locking means comprising a locking member mounted on the block for being selectively moved into locking engagement with a respective shaft, and each shaft having a slot defined therein for receiving a respective locking member in such locking engagement.

16. A holding foot as in claim 15, in which the block has left and right upper arms and corresponding left and right lower arms, said arms defining left and right pairs of vertically aligned holes for receiving said pair of vertical shafts.

17. A holding foot as in claim 16, in which each of the upper arms has means for retaining the locking member out of locking engagement with a respective shaft.

18. A holding foot as in claim 17, in which each locking member is a spring wire mounted on a respective upper arm, and said means for retaining the locking member out of locking engagement includes a groove formed in said upper arm for selectively receiving said spring wire.

19. A holding foot as in claim 16, in which the top transport has a foot bar secured to the block for actuating the holding foot, the foot bar being substantially parallel to the center lines of said pair of vertically aligned shaft-receiving holes.

20. A holding foot as in claim 19, further comprising a pair of angle brackets having vertical and horizontal arms, each foot sole being mounted on one of said vertical arms, and said horizontal arms being fixed to said block.

21. A holding foot as in claim 20, in which said block has a pair of slots defined therein parallel to said center lines in said shaft-receiving holes, and spurs are provided on said horizontal arms of said angle brackets for being inserted into said slots to secure said angle brackets against rotation with respect to said block.

22. A holding foot as in claim 20, in which said shafts extend substantially perpendicularly from said horizontal arms of said angle brackets.

23. A holding foot as in claim 22, in which the locking means are mounted on upper surfaces of said upper arms, the slot in each shaft is defined substantially parallel to the respective upper arm of the block, and the slot is disposed above the respective upper arm when the foot sole is locked to the block.

* * * * *